United States Patent [19]

Tanaka et al.

[11] 4,419,181

[45] Dec. 6, 1983

[54] METHOD FOR ETCHING METALLIC SHEET

[75] Inventors: Hiroshi Tanaka; Fusao Sakata, both of Fukaya, Japan

[73] Assignee: Tokyo Shibaura Denki Kabushiki Kaisha, Kawasaki, Japan

[21] Appl. No.: 409,350

[22] Filed: Aug. 19, 1982

Related U.S. Application Data

[62] Division of Ser. No. 248,795, Mar. 30, 1981, Pat. No. 4,357,196.

[30] Foreign Application Priority Data

Apr. 2, 1980 [JP] Japan ..... 55-41957

[51] Int. Cl.[3] ..... C23F 1/02

[52] U.S. Cl. ..... 156/640; 156/644; 156/651; 156/656; 313/402

[58] Field of Search ..... 156/640, 644, 345, 638, 156/654, 659.1, 661.1, 634, 651, 656; 134/64 R, 122 R; 445/47; 313/402, 403

[56] References Cited

U.S. PATENT DOCUMENTS

| | | | |
|---|---|---|---|
| 3,929,551 | 12/1975 | Frantzen | 156/640 X |
| 4,013,498 | 3/1977 | Frantzen et al. | 156/345 |
| 4,124,437 | 11/1978 | Bond et al. | 156/644 X |
| 4,303,466 | 12/1981 | Thoms | 156/644 X |

*Primary Examiner*—William A. Powell
*Assistant Examiner*—Thomas Bokan

[57] ABSTRACT

The invention provides method for etching a metallic sheet. The method includes a first step of forming an anticorrosive pattern defining apertures on one surface of the metallic sheet and an anticorrosive pattern defining smaller apertures than said apertures on the other surface of said sheet; a second step of lightly etching said the other surface for removing an oxide film on the surface of the metal to expose the surface of the metal; a third step of spraying an etching solution on said one surface for etching said one surface to a predetermined depth; and a fourth step of simultaneously spraying an etching solution on both surfaces of said metallic sheet for forming apertures in said metallic sheet. The invention provides an apparatus for practicing this method. The invention is preferably applied for forming apertures by etching in a metallic sheet to provide a shadow mask of a color CRT.

4 Claims, 9 Drawing Figures

METHOD FOR ETCHING METALLIC SHEET

This is a division, of application Ser. No. 248,795 filed Mar. 30, 1981 now U.S. Pat. No. 4,357,196.

The present invention relates to a method for etching a sheet of metallic material and, more specifically, a method for etching to precisely form apertures or openings in a continuous sheet of metal for a shadow mask of a color cathode-ray tube (CRT), and also relates to a device used for practicing this method.

Fine picture quality is required for a color cathode-ray tube (CRT), particularly for a color CRT for monitoring or display purposes. The shadow mask or the aperture mask, which is mounted to such a color CRT, needs to have tiny openings or apertures of high precision through which the electron beams pass.

FIG. 1 is an enlarged plan view of the main part of a shadow mask, and FIG. 2 is a sectional view along the line II—II of FIG. 1. Referring to FIG. 1, reference numeral 1 denotes a metallic sheet which is the material for the shadow mask, and 2 denotes rectangular apertures formed in the metallic sheet 1. Electron beams 3 (FIG. 2) emitted from electron guns (not shown) pass through the apertures 2 and impinge upon phosphor coated on the face plate of a color CRT (not shown). In order to prevent the electron beams from reflecting inside the apertures 2, each aperture 2 consists of two parts; an aperture 2A of small diameter formed at the side facing the electron guns, and an aperture 2B of large diameter formed at the side facing the phosphor screen. The depth t of the aperture 2A of small diameter is formed to be smaller than the depth T of the aperture 2B of large diameter. In FIG. 3, circular apertures 12 are formed in a metallic sheet 11 in place of the rectangular apertures 2 of FIG. 1. As may be apparent from FIG. 4 which is a sectional view along the line IV—IV of FIG. 3, each aperture 12, for the same reason as described with reference to FIG. 2, consists of an aperture 12A of small diameter formed at the side facing the electron guns, and an aperture 12B of large diameter formed at the side facing the phosphor screen. The depth t′ of the aperture 12A of small diameter is formed to be smaller than the depth T′ of the aperture 12B of large diameter. Referring to FIG. 4, reference numeral 13 denotes the incident electron beams.

For forming the apertures by etching in an extremely thin metallic sheet, it is possible to form apertures of high precision and with less variation since the etching time is short. However, since such a thin metallic sheet lacks mechanical strength, when press forming the apertured sheet into the form of the shadow mask or mounting the formed shadow mask inside the color CRT, the sheet or the shadow mask may be easily deformed. For forming the apertures in a thick metallic sheet, the etching time becomes long, resulting in over-etching and irregular etching. This over-etching causes lateral etching and large apertures, so that formation of apertures with high precision and with less variation becomes difficult. For forming the apertures shown in FIGS. 1 to 4 in the metallic sheet, etching is conventionally performed from both surfaces of the sheet. However, the problems caused by the above-mentioned lateral etching cannot be solved. As a method for eliminating these problems, a method is known according to which one surface of the metallic sheet is etched to a predetermined depth, washed and dried; the etched surface is coated with a varnish or a resin; and then the other surface of the sheet is etched for forming the apertures. Another method for eliminating these problems is disclosed in U.S. Pat. No. 4,013,498. According to this patent, one surface of a metallic sheet having an etchant resist pattern on both surfaces is covered with a removable sheild, and the other surface is etched, after removing the above-mentioned shield, etching of both surfaces of the metallic sheet is performed to form the openings. However, in both these methods, since one surface of the metallic sheet is covered with a coating material and this must be removed thereafter, the number of steps increases, adversely affecting the manufacturing cost of the objective product.

It is an object of the present invention to provide a method and device for etching a metallic sheet according to which apertures of high precision may be formed simply and continuously with less variation.

According to an aspect of the present invention, there is provided a method for etching a metallic sheet comprising:

- a first step of forming an anticorrosive pattern defining apertures on one surface of the metallic sheet and an anticorrosive pattern defining smaller apertures than said apertures on the other surface of said sheet;
- a second step of lightly etching said the other surface for removing an oxide film on the surface of the metal to expose the surface of the metal;
- a third step of spraying an etching solution on said one surface for etching said one surface to a predetermined depth; and
- a fourth step of simultaneously spraying an etching solution on both surfaces of said metallic sheet for forming apertures in said metallic sheet.

According to another aspect of the present invention, there is also provided an apparatus for etching a metallic sheet comprising:

- means for transferring a metallic sheet having an anticorrosive pattern defining apertures on its bottom surface and an anticorrosive pattern defining apertures smaller than said apertures on its upper surface;
- a first chamber having means for coating an etching solution on the upper surface of said transferred metallic sheet, means for drawing in said coated etching solution, and means for spraying an etching solution on the bottom surface of said metallic sheet;
- and a second chamber having means for spraying an etching solution on the upper surface and the bottom surface of said metallic sheet transferred from said first chamber.

This invention can be more fully understood from the following detailed description when taken in conjunction with the accompanying drawings, in which.

The present invention will now be described by way of its examples with reference to FIGS. 5 to 9.

Figure 5:
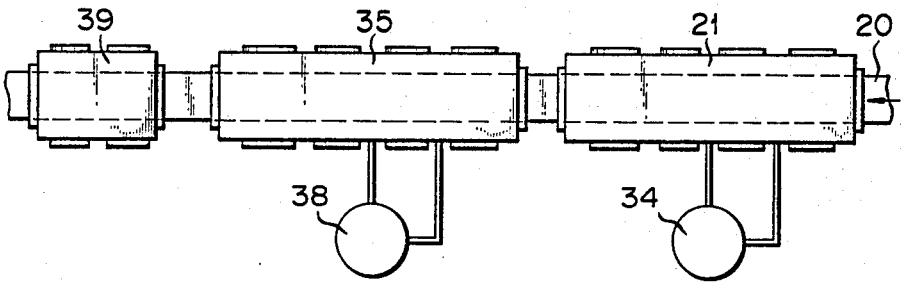
FIG. 5 is a plan view illustrating an etching device according to an example of the present invention.
Figure 6:
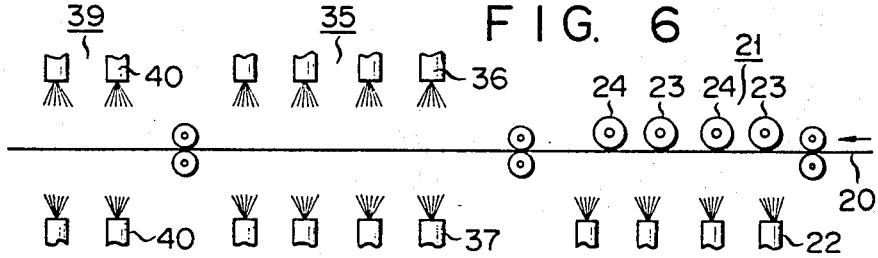
FIG. 6 is a model view illustrating the interior of the apparatus shown in FIG. 5.

Referring to FIGS. 5 and 6, reference numeral 20 denotes a metallic sheet which travels horizontally in the direction of the arrow in FIG. 6. A photoresist pattern (not shown) defining apertures of small diameter is formed on the upper surface of the sheet 20, and another photoresist pattern (not shown) defining apertures having larger dimensions than the apertures of small diameter described above is formed on the bottom surface. When the metallic sheet 20 is used as the shadow mask of the color CRT, the apertures of small diameter are formed at the side facing the electron guns and the apertures of large diameter are formed at the side facing the phosphor screen.

Figure 7:
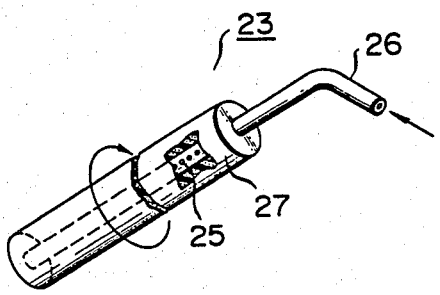
FIG. 7 is a perspective view of a coating roller for an etching solution.
Figure 8:
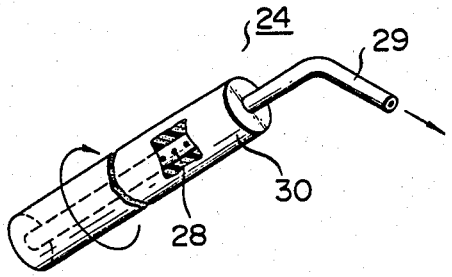
FIG. 8 is a perspective view of a suction roller for an etching solution.

First, the metallic sheet 20 enters a first chamber 21. In the first chamber 21, the upper surface of the sheet 20 is lightly etched to a degree that a metal oxide film on its surface is removed and the metal surface is exposed, and the bottom surface of the sheet 20 is etched to a predetermined depth by being sprayed with an etching solution from nozzles 22 stationed below. A preferable method for performing the light etching of the upper surface of the sheet 20 is to alternately bring coating rollers 23 for coating the etching solution and suction rollers 24 for drawing in the etching solution into contact with the upper surface of the sheet 20 with a fixed distance between the rollers. Each of the coating rollers 23 for coating the etching solution on the upper surface of the sheet 20 comprises a conduit 26 for the etching solution, the conduit having a number of holes 25 and a sponge roller 27 covering it, as shown in FIG. 7. The etching solution supplied by the conduit 26 is applied to the upper surface of the sheet 20 through the holes 25 and the sponge roller 27. Each of the suction rollers 24 for drawing in the coated etching solution comprises a suction tube 29 for the etching solution, the suction tube having a number of holes 28 and a sponge roller 30 covering it, as shown in FIG. 8. The etching solution drawn in by the sponge roller 30 is drawn inside the suction tube 29 through the holes 28. The rollers 27, 30 are made of sponge not to damage the photoresist.

Figure 9:
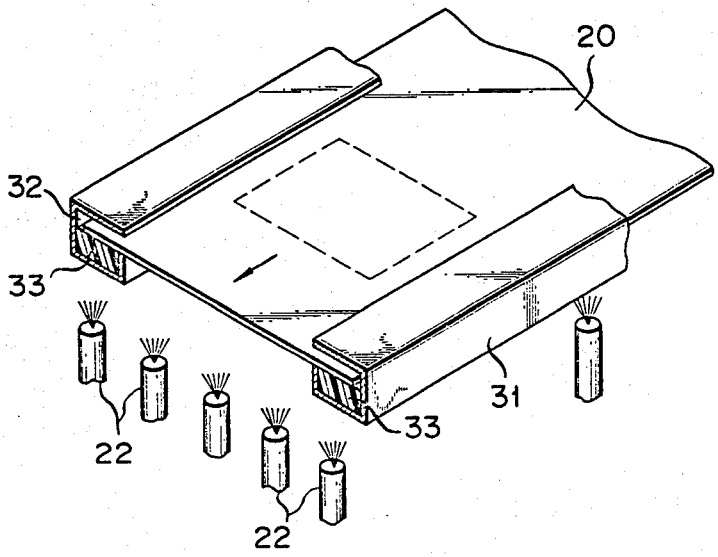
FIG. 9 is a perspective view illustrating the manner in which the etching solution is sprayed from below on the bottom surface of the metallic sheet in the first chamber.

FIG. 9 shows a pair of guide members 31 for preventing the etching solution sprayed from the nozzles 22 to the bottom surface of the metallic sheet 20 travelling in the direction of the arrow from moving to the upper surface of the sheet 20. Both sides of the metallic sheet 20 slide within guide grooves 32 of the guide members 31. Lower parts 33 of the guide grooves 32 are made of an elastic material having magnetic properties, such as a magnetic resin. The lower surface portions near both sides of the sheet 20 are magnetically attracted to the lower parts 33 of the grooves 32 so that floating of the travelling sheet 20 is prevented. Consequently, the etching solution sprayed on the bottom surface of the sheet 20 from the nozzles 22 is prevented from adhering to the upper surface of the sheet 20. The etching solution sprayed on the bottom surface of the metallic sheet 20 from the nozzles 22 inside the first chamber 21 may, for example, be a solution of ferric chloride ($FeCl_3$). The temperature of this solution is 68° C., the specific weight is 1.0470, and the spray pressure of this etching solution is 2.0 kg/cm$^2$. Referring to FIG. 5, reference numeral 34 denotes a tank for holding the etching solution to be sprayed. The composition of the etching solution coated on the front surface of the sheet 20 by the coating rollers 23 shown in FIG. 7 is concentrated sulfuric acid (50 cc), oxalic acid (1.25 kg, solid), 50% hydrogen peroxide solution (750 cc), and water (50 l).

The sheet 20 which has passed through the first chamber 21, then enters a second chamber 35. In the second chamber 35, the upper surface of the sheet 20 and the bottom surface of the sheet 20 are simultaneously sprayed with the etching solution from nozzles 36 and 37, respectively, and apertures are thereby formed in the sheet 20.

The etching solution sprayed on the upper and bottom surfaces of the sheet 20 is a solution of ferric chloride and is supplied from a tank 38. The specific weight of this solution is 1.0460 and its temperature is 50° C. The spray pressure of the solution sprayed on the upper surface of the sheet 20 is 1.5 kg/cm$^2$, and the spray pressure sprayed on the bottom surface is 2.0 kg/cm$^2$. The sheet 20 which has passed through the second chamber now enters a third chamber 39 where it is sprayed with water on its upper and bottom surfaces by nozzles 40, and it is transferred to the next step.

The important point to note in the series of steps described above is that the front surface of the metallic sheet 20 is lightly etched for removing the metal oxide film before it is sprayed with the etching solution. Due to this, the etching solution sprayed on the upper surface of the sheet 20 in the next step may quickly and uniformly adhere to the exposed surface of the metal, and the lateral etching which occurs during the formation of apertures of small diameter at the side where the electron beams are incident may be reduced to the minimum. Thus, it becomes possible to continuously form apertures of high precision and less variation in the metallic sheet. Furthermore, since one surface of the metallic sheet need not be temporarily covered for protection as in the conventional case, the manufacturing method may be advantageously made simpler. Although the light etching of the upper surface of the sheet 20 and the strong etching of the rear surface of the sheet are simultaneously performed in the first chamber 21 according to the above example, the etching of the front and rear surface of the sheet may be separately performed before the etching in the second chamber 35.

Experiments demonstrating the effects obtained by the present invention were performed in a manner to be described below. A metallic sheet of 0.15 mm thickness was prepared which had a photoresist pattern of 0.100 mm overall dimension defining apertures of large diameter on its bottom surface and a photoresist of 0.02 mm overall dimension defining apertures of small diameter on its upper surface. This metallic sheet was etched to form apertures according to the method shown in the example described above. As a result, apertures of large diameter with 0.180 mm overall dimension were formed on the rear surface of the sheet. The difference $0.180-0.100=0.080$ mm was caused by lateral etching during the formation of the apertures of large diameter. On the other hand, the apertures of small diameter with 0.07 mm overall dimension were formed on the upper surface of the sheet. Thus, the difference $0.07-0.02=0.05$ mm was caused by lateral etching during the formation of the apertures of small diameter.

Figure 1:
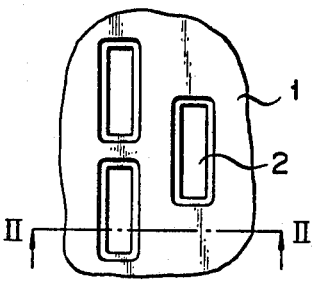
FIG. 1 is a plan view illustrating rectangular apertures formed in a metallic sheet.
Figure 3:
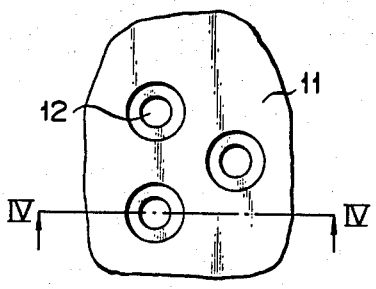
FIG. 3 is a plan view illustrating circular apertures formed in a metallic sheet.
Figure 2:
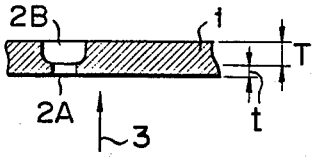
FIG. 2 is a sectional view along the line II—II of FIG. 1.
Figure 4:
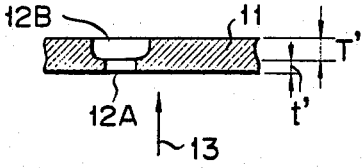
FIG. 4 is a sectional view along the line IV—IV of FIG. 3.

The depth (e.g., t shown in FIG. 2) of the apertures of small diameter was about 0.03 mm, and very little reflection of the electron beams inside the apertures of small diameter was observed.

The method of the present invention may not only be applied to the manufacture of a shadow mask, but also to other cases where finer apertures smaller than the thickness of the metallic sheet must to be formed in the metallic sheet.

What we claim is:

1. A method for etching a metallic sheet comprising:

a first step of forming an anticorrosive pattern defining apertures on one surface of the metallic sheet and an anticorrosive pattern defining smaller apertures than said apertures on the other surface of said sheet;

a second step of lightly etching said the other surface for removing an oxide film on the surface of the metal to expose the surface of the metal;

a third step of spraying an etching solution on said one surface for etching said one surface to a predetermined depth; and a fourth step of simultaneously spraying an etching solution on both surfaces of said metallic sheet for forming apertures in said metallic sheet.

2. A method according to claim 1, wherein said second and third steps are performed simultaneously.

3. A method according to claim 1, wherein the etching solution is sprayed on said one surface from below in said third step.

4. A method according to claim 1, wherein said metallic sheet is used as a material for a shadow mask for a color cathode-ray tube.

* * * * *